United States Patent [19]

Shelton et al.

[11] Patent Number: 4,814,783

[45] Date of Patent: Mar. 21, 1989

[54] FORESHORTENED ANTENNA STRUCTURES

[75] Inventors: Warren M. Shelton, Milpitas; Samuel C. Kuo, Saratoga, both of Calif.

[73] Assignee: GTE Government Systems Corporation, Stamford, Conn.

[21] Appl. No.: 131,884

[22] Filed: Dec. 11, 1987

Related U.S. Application Data

[63] Continuation-in-part of Ser. No. 118,378, Nov. 9, 1987, Pat. No. 4,754,287.

[51] Int. Cl.[4] ..... H01Q 9/28

[52] U.S. Cl. ..... 343/795; 343/793; 343/792.5; 343/803

[58] Field of Search ..... 343/795, 793, 794, 792.5, 343/801, 802, 803, 806, 807, 808, 908

[56] References Cited

U.S. PATENT DOCUMENTS 3,732,572 5/1973 Kuo ..... 343/792.5
4,673,948 6/1987 Kuo ..... 343/792.5
4,754,287 6/1988 Shelton et al. ..... 343/792.5

OTHER PUBLICATIONS

Kuo; "Size Reduced Log Periodic Dipole Array"; 1970 G-AP International Symposium; pp. 151-158; 1970.

Kuo; "Size Reduced Log Periodic Dipole Array Antenna"; Microwave Journal (GB); vol. 15, No. 12, pp. 27-33; 1972.

*Primary Examiner*—William L. Sikes
*Assistant Examiner*—Hoanganh Le
*Attorney, Agent, or Firm*—Douglas M. Gilbert

[57] ABSTRACT

The foreshortened dipoles of the antenna described in U.S. Pat. No. 3,732,572 are further substantially shortened with a new construction in which each radiating element comprises two portions. A planar rectangular body electrically connects to the feed point by a stem portion which attaches to the rectangular body at the farthest point from the feed point and is spaced slightly from the plane of the body to electrically isolate the two portions.

18 Claims, 7 Drawing Sheets

FORESHORTENED ANTENNA STRUCTURES

CROSS-REFERENCES TO RELATED APPLICATIONS

This application is a continuation-in-part of application Ser. No. 118,378, filed Nov. 9, 1987, and entitled "LOG PERIODIC ANTENNA WITH FORESHORTENED RADIATING ELEMENTS now U.S. Pat. No. 4,754,287."

BACKGROUND OF THE INVENTION

1. Field of the Invention

This invention relates to antennas and more particularly to foreshortened monopole and dipole antennas.

2. Description of the Prior Art

The physical length of a linear monopole or dipole antenna is inversely proportional to its operating frequency. Monopoles or dipoles designed for use at frequencies at or above the UHF range (i.e. >300 MHz) have overall lengths that are relatively short. For instance a monopole antenna operating at 300 MHz is approximately only 10 inches in length. However, there are many applications where the length of UHF or microwave frequency dipole or monopole antennas are too large for certain applications and may need to be reduced by 50% or more. For operation in the HF or low VHF frequency range, the length of the linear monpole or dipole can be reduced up to 50% by inductive loading. The inductive loading of the monopole or dipole antenna is accomplished by physically inserting inductors at various parts on the linear monpole or dipole. For frequencies above the UHF range, this reduction technique becomes impractical because the size of the inductors or capacitors is not negligible compared to the relatively small size of the dipole or monopole. In addition, it is difficult to obtain an inductor which will provide the exact amount of inductance without stray capacitance at microwave frequencies. For this reason, the foreshortening of the microwave monopole or dipole antennas is accomplished without using actual inductor or capacitors.

A technique which can be used to reduce the length of a monopole or dipole up to 45% is described in U.S. Pat. No. 3,732,572. This patent describes a log periodic dipole antenna (LPDA) in which certain radiating elements (dipoles) are foreshortened in order to conserve space without adversely affecting antenna performance. This is accomplished by configuring each size-reduced dipole with the interior profile of a double ridge waveguide. However, when these foreshortened dipoles are used as radiation elements in a practical commonly used log periodic dipole antenna, the width of such antennas cannot be reduced as much. The reason for this is that these antennas have taper angles of approximately 25%. Therefore the available spacing between adjacent dipole elements is relatively small and this prevents the use of foreshortened dipole elements with large width-to-length (B/A) ratios when the planes of these elements are parallel to the antenna axis. For example, the width of a log periodic dipole antenna with a taper angle of 20% can be reduced up to 30%, and one with a 30% taper angle can only be reduced by approximately 25%. Log periodic dipole antennas having a very small taper angle (less than 10%), and therefore characterized by long structures and large spacings between adjacent dipole elements, can be reduced up to 40% because foreshortened dipoles with large B/A ratios can be used. Nevertheless the 40% reduction in antenna width is still not sufficient to enable the antenna to fit into the space available in many applications.

A well known method of reducing the length of the linear monopole or dipole antenna is the top disk loading technique. A monopole version of this antenna consists of two parts:

1. a wire stem with a length of (a), and
2. a loading disk with a diameter of (d) mounted on the stem.

The reduction factor of the disk antenna is directly proportional to the size (surface area) of the disk if the length of the stem is kept constant. The length of a dipole or monopole can be reduced by 70% by using top disk loading. However, for reduction greater than 50%, (d) becomes greater than (a). This configuration, a three dimensional body, is structurally very difficult to use with either the LPDA's or the Yagi antennas. Furthermore, when the disk antenna is used as a single, stand alone antenna, it is difficult for an antenna designer to know whether to treat it as a monopole or a disk antenna, and it is very difficult to support it because it because of the top loading.

This invention is directed to an improved foreshortened monopole or dipole antenna construction which overcomes these limitations.

OBJECTS AND SUMMARY OF THE INVENTION

A general object of the invention is the provision of a UHF or microwave monopole or dipole antenna foreshortened by up to 70% and consistent with an electrical performance (VSWR) equivalent to that of a corresponding conventional monopole or dipole antenna.

These and other objects are achieved with a radiating element (monopole or half dipole) having two portions. A conductive stem portion connects at one end to an excitation potential. The second portion is a plane rectangular conductive body electrically connected at an edge to the opposite end of the stem portion and folded over the stem to be parallel to and closely spaced from the stem. The length of the radiating element being forshortened in comparison to the length of a standard half dipole antenna operating at the same frequency, i.e. $\lambda/4$.

DESCRIPTION OF PREFERRED EMBODIMENTS

Figures 1, 2:
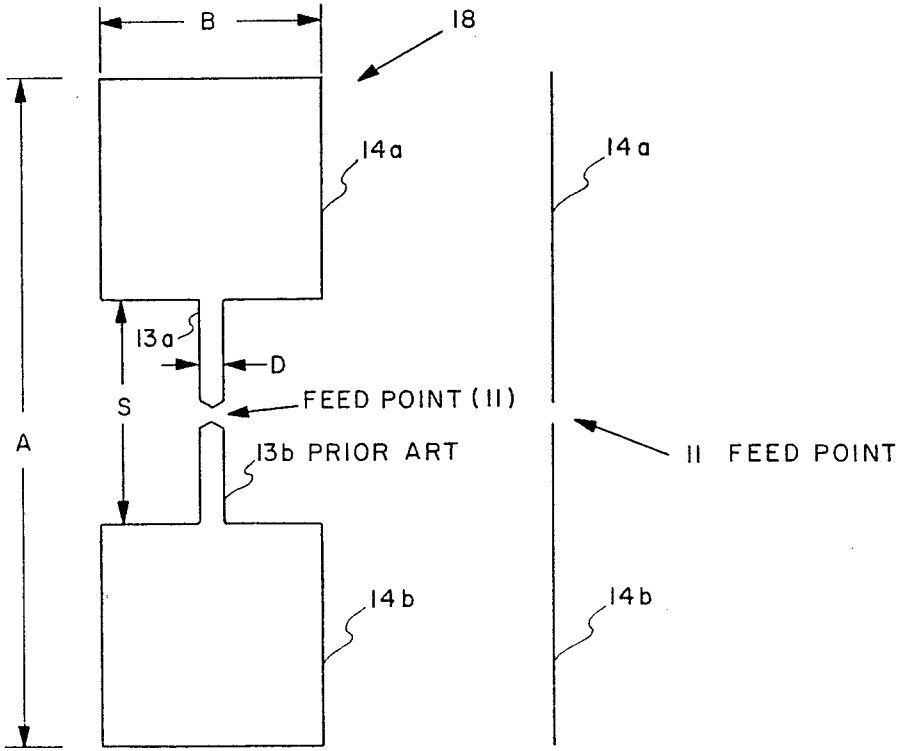
FIG. 1 is a schematic plan view of a prior art dipole antenna foreshortened in accordance with the teachings of U.S. Pat. No. 3,732,572.
FIG. 2 is a side view of the dipole antenna shown in FIG. 1.

Referring now to the drawings, FIG. 1 shows a prior art dipole antenna 18 comprising identical rectangular bodies 14*a* and 14*b*, connected by stems 13*a* and 13*b* to a feed point 11. FIG. 2 shows a side-view of the prior art antenna of FIG. 1. Each of rectangular bodies 14*a* and 14*b* is a plane electrically conductive sheet and each of stems 13*a* and 13*b* is an electrically conductive strip.

Figures 3, 4:
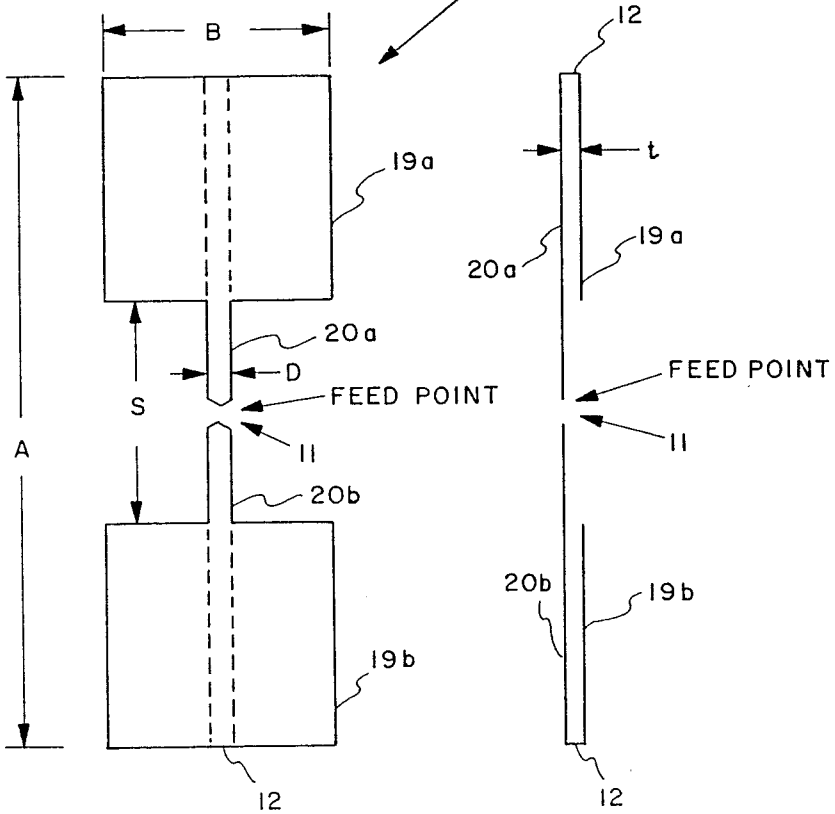
FIG. 3 is a schematic plan view of a dipole antenna foreshortened in accordance with the teachings of this invention.
FIG. 4 is a left-side view of the dipole antenna shown in FIG. 3.

Referring now to FIG. 3, one embodiment of this invention is disclosed wherein dipole antenna 17 is shown having an overall length A which is $<<\lambda/2$. The structure of dipole antenna 17 comprises identical solid rectangular bodies 19*a* and 19*b*, connected by stems 20*a* and 20*b* to an electrical feed point 11. FIG. 4, a side-view of antenna 17 of FIG. 3, shows that the planar rectangular bodies 19*a* and 19*b* are folded over the stem portions 20*a* and 20*b*. As with the prior art antenna, each of rectangular bodies 19*a* and 19*b* is a plane electrically conductive sheet or plate and each of stems 20*a* and 20*b* is an electrically conductive strip which may not necessarily be fabricated out of the same material as the rectangular bodies 19*a* and 19*b*. The principal difference in the structure of dipole 17 compared to that of prior art dipole 18 shown in FIG. 1 is that each rectangular body section 19*a* and 19*b* is folded over the respective stem portions to extend parallel to and be slightly spaced by a distance t from the longitudinal axis of the stems. The dimension (t) is relatively small, i.e. in the order of 1/10 to 1/20th of the dipole length, so that for operational purposes the antenna is essentially two-dimensional. The only requirement is that the stem portions 20*a* and 20*b* be electrically isolated from the planar rectangular bodies 19*a* and 19*b*, respectively, except at the connection point 12. Therefore, the dimension (t) could be made very small if a thin insulating strip was inserted between the two portions 19 and 20.

As explained in U.S. Pat. No. 3,732,572, the dipole length reduction factor is directly related to the ratios of parameters B/A and B/D, see FIG. 1. The larger the ratios, the larger the reduction factor obtainable. There is, however, a practical limit to the extent that such ratios can be increased. Too large a ratio of B/D makes the antenna difficult or impossible to fabricate. Too large a ratio of B/A results in antenna support problems and incompatibility with log periodic dipole antenna design. For these reasons, the ratios of B/A and B/D in the antenna described in the above patent are limited to 0.3 and 20, respectively. For a foreshortened dipole antenna built in accordance with the subject invention, the dipole length reduction factor is also related to the ratio of B/A and B/D (the larger the ratio, the larger the reduction factor). The same practical limitations of the B/A and B/D ratios of the prior art foreshortened dipole also applies to the subject foreshortened dipoles when they are used as radiating elements for LPDA's. As a stand alone antenna, however, the B/A and B/D ratio of the subject antenna can be increased to as much as 0.5 and 30 respectively. Much beyond these values and practical considerations become a dominant factor, such as fabrication and structural support difficulties. Another design parameter, the ratio of S/A also affects the reduction factor. For the prior art antenna, a value of S/A=0.55 will provide the maximum reduction factor. For the subject antenna the optimum S/A ratio is somewhat lower than 0.55. In comparison a dipole foreshortened in accordance with the subject invention had the following dimensional ratios: B/A=0.3, B/D=10, and S/A=0.1. With a value of t=0.05A, the subject dipole had the same resonant frequency as that of a conventional linear dipole have a length 2.5 times longer. This corresponds to a reduction factor of 60%. The prior art dipole with a similar B/A and B/D ratio and an optimum S/A of 0.55 can only obtain a reduction factor of 38%. The reduction factor will increase when the ratios B/A and B/D are increased. This is demonstrated by making an antenna with B/A=0.5, B/D=20, S/A=0.1 and t=0.05A. In this instance the reduction factor is 70%. Unlike the prior art antenna, the resonant frequency of the foreshortened dipole is somewhat related to the low cutoff frequency of a double ridged waveguide of the same outline. The low cutoff frequency of a doubly ridged waveguide as a function of the ratios of B/A, B/D and S/A versus the low cutoff frequency of a rectangular waveguide of the same B and A dimensions are available in many Microwave Handbooks. The design of the subject antenna, however, is for the most part empirical where trial and error processes are used in order to achieve a particular reduction factor.

Figure 5:
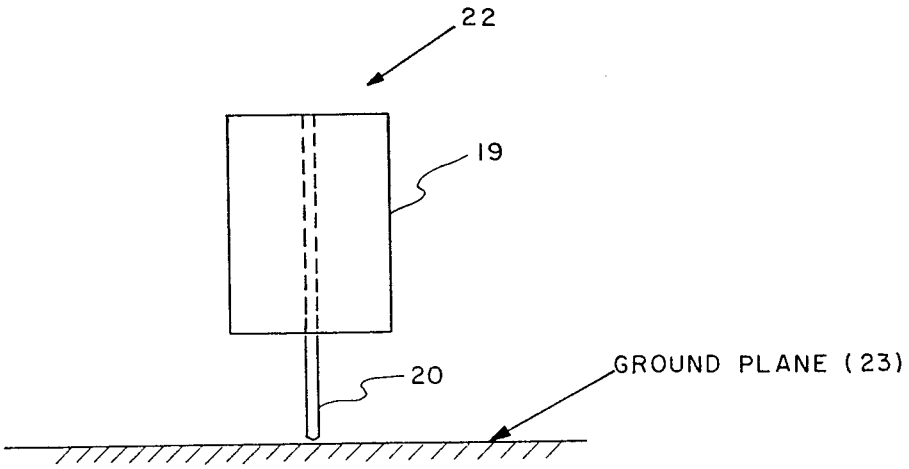
FIG. 5 is a view similar to FIG. 3 showing a monpole antenna embodying the invention.
Figure 6:
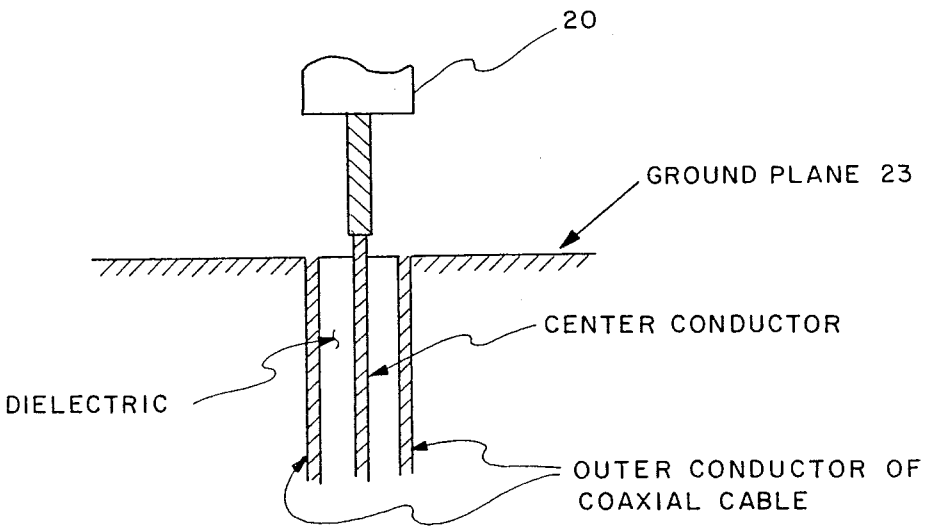
FIG. 6 is an enlarged view of part of FIG. 5 showing details of the monopole feed.

The invention may also be practiced with a monopole antenna 22, see FIGS. 5 and 6, having the same structure as one-half of dipole 17 and mounted over a planar conductor 23 such as a metal sheet or ground, like reference characters indicating like parts on the drawings. Antenna 22 is fed by coaxial cable 11 with inner conductor 11a connected to stem 20 and outer conductor 11*b* connected to planar conductor 23. It should also be pointed out that when B in FIG. 3 is reduced to the same dimension as D, the subject structure resembles the U-loading dipole which is an extreme case of the subject antenna. However, the reduction factor of the subject antenna is much greater (2 to 1) than with the U-loading dipole (B=D).

Figure 7:
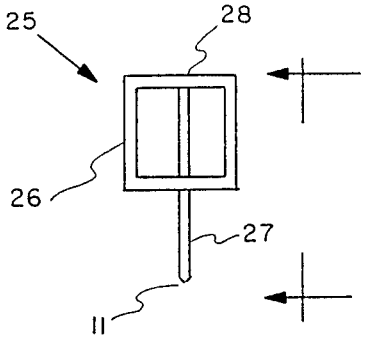
FIG. 7 is a schematic plan view of anotehr monopole antenna embodying a modified form of this invention.
Figure 8:
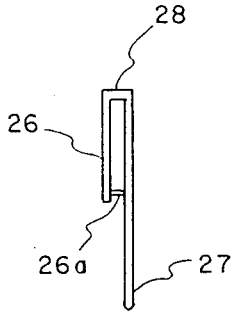
FIG. 8 is an edge view taken on line 8—8 of FIG. 7.
Figure 12:
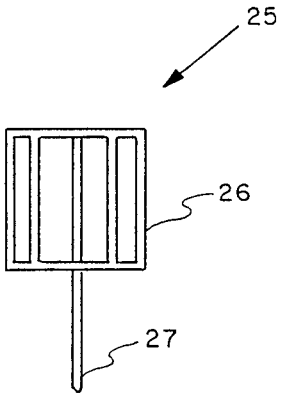
FIG. 12 is a schematic plan view of another monopole antenna embodying a modified form of this invention.

Another embodiment of the invention is shown in FIGS. 7 and 8 in which monopole 25, one-half of which is illustrated, has an open-faced rectangular frame 26 connected by stem 27 to feed point 11. Frame 26 may be formed by wire or the like as described in the above patent, stem 27 being slightly laterally spaced from frame 26 and connected to the midpoint or central part of the edge 28 thereof remote from feed point 11. This form of the invention is useful in outdoor applications where wind is a factor. To increase the structural integrity of the cantilevered frame 26, an insulating standoff 26*a* may be used to maintain the spacing between frame 26 and stem 27. Unfortunately, this "wire version" of the invention does not provide the same length reduction factor as compared to an antenna of the same dimensions using solid conducting sheets as shown in FIG. 3. When more lateral wires are added into the rectangular frame, as shown in FIG. 12, the reduction factor increases.

Figure 9:
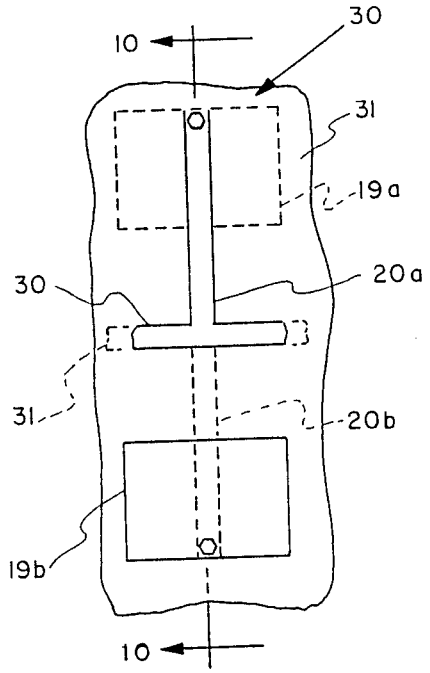
FIG. 9 is a schematic plan view of a dipole embodying the invention and fabricated using the printed circuit board technique.
Figure 10:
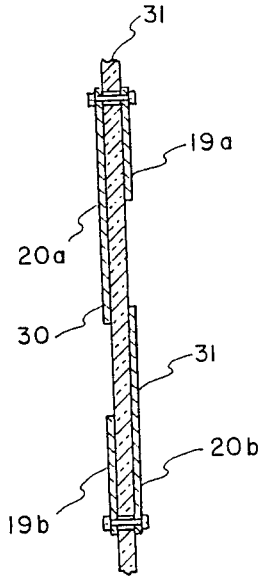
FIG. 10 is a section taken on line 10—10 of FIG. 9.
Figure 11:
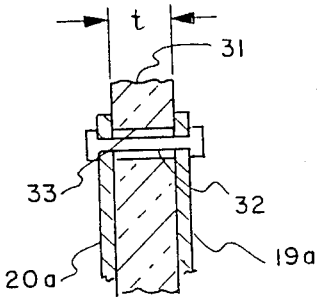
FIG. 11 is an enlarged view of part of FIG. 10.

FIGS. 7, 8 and 9 illustrate another embodiment of the invention in which the dipole 30 is formed by the printed circuit (PC) technique, like reference characters indicating like parts on the drawings. One-half of dipole 30 is formed on one side of PC board 31, the other half on the opposite side. Each of rectangular bodies 19*a* and 19*b* of the dipoles preferably is in sheet form as shown but may also have an open configuration as in dipole 25 (FIGS. 5 and 6). Stems 20*a* and 20*b* connect to and are integral with strip feed lines 30 and 31 on opposite sides of board 31 and are connected at the outer edges, respectively, of rectangular bodies 19*a* and 19*b* by pins 32 extending through holes 33 in board 31. The thickness t' of board 31 corresponds to the lateral offset (t) of stems 20 from the planes of rectangular bodies 19 in the embodiments described above. The high production and precision capabilities inherent in forming such antennas by printed circuit technology make this embodiment of the invention highly cost effective. The formation this antenna by printed circuit technology enables high volume production with corresponding high quality.

It is fairly obvious to those skilled in the art that any of the antenna embodiments herein described have many different applications in multi-element antennas, such as in a log periodic antenna more completely described in the copending application referred to above.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A foreshortened dipole antenna structure for operating at frequencies at and above 300 MHz, said structure having a longitudinal axis and comprising:

two identical half-dipole sections with each section comprising:

an elongated conductive stem portion disposed along said axis having two ends for connection at one end to an excitation potential, said stem portion having a width dimension D; and a conductive rectangular body portion having a width B where B>D, said body portion connected only at the midpoint of one edge to the other end of said stem portion and folded over said stem at said midpoint of one edge, said body portion disposed parallel to said axis and spaced slightly from said stem portion to be electrically insulated therefrom;

each half-dipole section dipsosed along said axis, such that the excitation ends of said stems are spaced adjacent; and said dipole antenna having an overall length much less than $\lambda/2$ where $\lambda$ is the wavelength of the resonant frequency of the dipole antenna.

2. A foreshortened dipole antenna structure as in claim 1 wherein said stem portion is a flat metallic strip having a structurally supporting insulating material on one side thereof.

3. A foreshortened dipole antenna structure as in claim 2 wherein said body portion is a continuous flat metallic sheet having one side thereof a structurally supporting insulating material being in common with said stem insulating material.

4. A foreshortened dipole antenna structure as in claim 1 wherein said stem portion is a wire rod of diameter D.

5. A foreshortened dipole antenna structure as in claim 1 wherein said stem portions and said body portions are double-sided printed circuit structure formed on a common insulating substrate.

6. A monopole antenna structure for connection to an energizing feed line comprising:

a conductive elongated stem having a length L, a width D, and two ends for connection at one end to an energizing feed line, said stem also having a longitudinal axis disposed transversely to said feed line;

a conductive body having a width B>D, said body spaced slightly above the plane defined by said feed line and said stem axis, the other end of said stem opposite said one end thereof being connected to said body only along the edge thereof furthest from said feed line, said body and said stem being electrically isolated except at said connection;

said monopole having a stem length L much less than $\lambda/4$, where $\lambda$ is the wavelength at the resonant frequency of the monopole antenna.

7. The antenna according to claim 6 in which said body is a flat electrically conductive continuous sheet.

8. The antenna according to claim 7 in which said stem is an electrically conductive wire.

9. The antenna as in claim 8 for operation above 300 MHz.

10. A foreshortened half-dipole antenna structure for operation at frequencies above 300 MHz, said structure having a longitudinal axis and comprising:

an elongated conductive stem portion disposed along said axis having two ends for connection at one end to an excitation potential, said stem portion having a width dimension D;

a conductive rectangular body portion having a width B where B >D, said body portion connected only at the midpoint of one edge to the other end of said stem portion and folded over said stem at the connection, said body portion disposed parallel to said axis and spaced slightly from said stem portion to be electrically insulated therefrom;

said half-dipole antenna having an overall length much less than $\lambda/4$ where $\lambda$ is the wavelength at the resonant frequency of the half-dipole antenna.

11. A foreshortened half-dipole antenna structure as in claim 10 wherein said stem portion is a flat metallic strip having a structurally supporting insulating material on one side thereof.

12. A foreshortened half-dipole antenna structure as in claim 11 wherein said body portion is a flat metallic sheet having a structurally supporting insulating material on one side thereof, said body insulating material being in common with said stem insulating material.

13. A foreshortened half-dipole antenna structure as in claim 10 wherein said body portion is a flat metallic plate.

14. A foreshortened half-dipole antenna structure as in claim 13 further comprising:

insulating spacer means connected to said stem portion and to said flat metallic plate at the edge opposite said edge having the connection point for structurally supporting said flat metallic plate.

15. A foreshortened dipole antenna structure for operating at frequencies above 300 MHz, said structure having a longitudinal axis and comprising:

a pair of axially spaced half-dipole sections connected to energizing potential, said half-dipole sections extending in opposite directions and each comprising:

an elongated conductive stem portion disposed along said axis having two ends, one end connected to said energizing potential, said stem portion having a width dimension D; and a radiating frame portion having a generally rectangular outline with a width dimension B where B>D, said frame portion lying in a plane adjacent and parallel to and laterally spaced from said stem, electrically connected only at the midpoint of one edge to the other end of said stem portion and folded over said stem at said midpoint of one edge, said lateral spacing sufficient to maintain electrical isolation therefrom;

said dipole antenna having an overall length much less than $\lambda/2$ where $\lambda$ is the wavelength of the resonant frequency of the dipole antenna.

16. A foreshortened dipole antenna structure as in claim 15 wherein said frame portion comprises an electrically conductive wire in the shape of an open-faced rectangle.

17. A foreshortened dipole antenna structure as in claim 16 further comprising: insulating spacer means connected to said stem portion and to said frame portion at the edge opposite said midpoint of one edge for structurally supporting said conductive wire frame portion.

18. A foreshortened dipole antenna structure as in claim 15 further comprising a plurality of conductive members laterally spaced within and connected to said frame portion.

* * * * *